United States Patent [19]

Busker

[11] 3,970,515

[45] July 20, 1976

[54] CONTROLLED SEQUENCE PRESSURE NIP

[75] Inventor: Leroy H. Busker, Rockton, Ill.

[73] Assignee: Beloit Corporation, Beloit, Wis.

[22] Filed: Apr. 7, 1975

[21] Appl. No.: 565,427

Related U.S. Application Data

[63] Continuation-in-part of Ser. No: 412,578, Nov. 5, 1973, abandoned, which is a continuation of Ser. No. 241,710, April 6, 1972, abandoned.

[52] U.S. Cl. ..... 162/360 R; 100/151; 162/205

[51] Int. Cl.[2] ..... D21F 3/06

[58] Field of Search..... 162/205, 305, 358, 360 R; 100/35, 118, 119, 120, 151, 207, 208; 210/350, 351

[56] References Cited

UNITED STATES PATENTS

| | | | |
|---|---|---|---|
| 1,472,572 | 10/1923 | Tompkins | 162/358 X |
| 2,135,763 | 11/1938 | Nicholson | 100/51 |
| 3,748,225 | 7/1973 | Busker et al. | 162/358 X |
| 3,797,384 | 3/1974 | Hoff | 162/360 X |

*Primary Examiner*—S. Leon Bashore
*Assistant Examiner*—Richard V. Fisher
*Attorney, Agent, or Firm*—D. J. Veneman; B. L. Samlan; G. A. Mathews

[57] ABSTRACT

A press structure for performing a dewatering operation in the steps of formation of a traveling fibrous web such as in a paper making machine wherein the wet web is carried on one or more water absorbing felts through a press formed of a pair of extremely tough liquid impervious belts with the belts backed throughout a pressing zone by a series of fluid pressure chambers applying hydraulic pressures to the back of the belt. The chambers are arranged so that a first fluid pressure is applied at a first portion of the pressing zone, and subsequently a second higher pressure is applied to the belts at a second portion of the pressing zone and thereafter a third pressure is applied at a third portion. Each successive pressure is higher than the previous one so that the hydraulic resistance pressure of the moisture leaving the web does not build up at such a rate so as to disrupt the web fibers.

2 Claims, 10 Drawing Figures

CONTROLLED SEQUENCE PRESSURE NIP

CROSS REFERENCE TO RELATED APPLICATIONS

This application is a continuation-in-part of application Ser. No. 412,578 filed Nov. 5, 1973 which in turn is a continuation of application Ser. No. 241,710 filed Apr. 6, 1972, both now abandoned.

BACKGROUND OF THE INVENTION

The invention relates to improvements in presses for extracting water from a continuing traveling web such as a newly formed web in a paper machine, and particularly the invention relates to a structure for providing an extended press nip which applies a pressing force to a web for a longer continuous time than structures of the type conventionally used such as formed by the nip of opposed roll couples. The invention particularly relates to an improved structure and method for obtaining and squeezing more water from the web than heretofore possible and accomplishing this function without disruption of the web fibers to obtain the formation of an improved web.

In the copending application of Busker and Francik, Ser. No. 193,272, now U.S. Pat. No. 3,798,121, the principles and advantages of pressing a paper web for an extended period of time and the advantages thereof are discussed. In the present structure, the principles of an extended nip are utilized in a structure affording advantages over prior art arrangements. In prior art structures such as conventional opposed rolls, the pressing pressure applied to a web is applied suddenly as the web passes through the nip and suddenly released to be again applied at a succeeding nip. In high speed paper machines, the pressure is applied very suddenly and over a very short period of time, and it has been found that hydraulic pressures due to flow resistance build up within the web preventing the water from escaping. If the pressure is increased, the amount of water removed is not significantly increased because of the resistance of the water to escaping in the relatively short period of time. Further disadvantages are encountered in that web fiber disruption, commonly called "crushing", occurs if the water pressures build up too rapidly within the nip.

It is accordingly an important feature of the present invention to provide an improved extended nip press which applies pressures stepwise to the web so that the water within the web can flow out at an optimum rate to achieve maximum dewatering without fiber disruption.

As will be appreciated from the teachings of the disclosure, the features of the invention may be employed in the dewatering of other forms of webs than a paper web in a paper making machine. However, for convenience, a preferred embodiment of the invention will be described in the environment of a paper making machine which conventionally forms a web by depositing a slurry of pulp fibers on a traveling fourdrinier wire, transfers the web to a press section where the web passes through a number of press nips formed between roll couples, and the web then passes over a series of heated dryer drums and usually through a calender and then is wound on the roll. The present structure forms the entire press section and takes the place of other forms of press sections heretofore available. Many modifications can be made in this type of overall machine, as to the forming section, the press section, the dryer section, and the structure of the instant disclosure may be employed in pressing webs of various synthetic fibers.

The present invention relates to improvements for the press sections of a paper making machine. In such a machine the web usually arrives at the press section with about 80 percent web basis moisture (ratio of water to fiber plus water) and leaves the press section with approximately 60 percent moisture, with the remaining moisture having to be removed by thermal evaporation in the dryer section as the web passes over a series of heated dryer drums. Because of various inherent limitations in the operation of roll couples forming press nips for the press section in a conventional paper making machine, only a given amount of water can be removed in each nip and, therefore, in a conventional paper making machine, a series of three press nips are usually employed. It has been found impractical to attempt to remove a significant amount of additional water by increasing the number of press nips, although the further removal of water by pressing can greatly reduce the expense and size of the dryer section. It is estimated that if the water removed in the press section can be increased to decrease moisture from 60 percent to 50 percent, the length of the dryer section can be reduced by one-third. This is significant in a typical 3000 feet per minute newsprint machine which employs on the order of 100 dryer drums. The significance can be appreciated in considering that the dryer drums are each expensive to construct and to operate and require the provision of steam fittings and a supply of steam for each drum. The relative importance of the removal of water in the press section is further highlighted by the fact that one of the most important economic considerations in justifying a satisfactory return on investment in the operation of a paper making machine is to obtain the highest speed possible consistent with good paper formation and better pressing will shorten the necessary time in the dryer section and permit higher speeds.

It is accordingly an object of the present invention to provide an improvement in the press section of a paper machine which makes it possible to remove an increased amount of water in this press secton and makes it possible to provide a press section having only a single pressing nip of a unique elongated or extended nature which does not have the performance limitations of conventional roll couple presses and which requires far less space in terms of requirements as to the overall length of the press section. By increasing the amount of water removed from the web in the press section, increased speeds are possible with existing equipment, i.e., a given length of dryer section can operate at higher speeds since it is required to remove less water. Also, new equipment can be constructed requiring less machine length and expense.

The present invention employs a principle which may be referred to as the extended nip concept wherein the time the web is subjected to a pressing action is greatly extended, i.e., a single pressing is provided having a residence time which exceeds that of the time of the web in a number of conventional roll couple press nips. With the reduction to a single pressing operation, the compound effects of rewetting the web as it leaves a plurality of nips are avoided.

A factor which presently limits water removal from paper by mechanical web pressing is the flow property of water within the paper sheet. It has been found that other factors are not of dominant significance, for example, the effects of the moisture in the left which travels with the web are small. It has been found further that the length of time that the web is in the nip, in other words the residence in the nip, can have a significant effect in overcoming the difficulties created by the flow properties of the water within the sheet. It has also been found that merely by increasing the residence time of the web in the nip, the water content of the sheet coming out of the press can be decreased so that the web will have 46 percent dryness rather than 40 percent dryness with other variables remaining constant. As is evident, the residence time of a web in a conventional roll couple press nip is limited and can only be increased by decreasing the speed of travel of the web, or can be increased slightly by increasing the diameter of the press rolls, but these factors are indeed limiting. It has been found, for example, that by applying a 1300 pound per square inch pressure on a web for five minutes, a moisture level of less than 30 percent can be attained. Yet, under the dynamic short term mechanical pressing of a paper machine press section using roll couples, even with a plurality of nips, a great deal of effort is required to maintain moisture levels below 60 percent.

It has been found that significant losses in dryness occur at higher speeds and that a loss in dryness of over 5 percent is experienced in going from 300 feet per minute to 1000 feet per minute with typical press loadings in suction press. It has been found that a hydraulic pressure or wedge effect develops during the passage of the wet mat through the wet press nip. The hydraulic pressure that develops substracts from the applied load and reduces the mechanical compacting pressure. The result is a loss in dryness. As the machine speed increases, the compacting rates are higher, resulting in higher hydraulic pressures within the paper mat. These hydraulic pressures react against the pressure of the rolls and prevent the moisture from being squeezed from the web. The exact value of hydraulic pressure is difficult to determine either by direct measure or analysis because of the space and speeds involved. It is believed, however, that hydraulic pressure predominately determines press performance on machines operating at high speeds. Accordingly, the instant invention relates to avoiding disadvantages encountered with high speed press nips of the conventional type used in most commercial applications today, and provides a substantial increase in residence time within a press nip to allow time for flow to occur withint the mat and for the hydraulic pressure to dissipate. The principles of extended nip or extended time pressing are further reviewed in the aforementioned application.

SUMMARY OF THE INVENTION

The present invention increases the dryness of the web leaving the press section by passing the web through separate, successive, adjacent portions of the extended pressing zone wherein successively increasing hydraulic pressure is applied to the web. This prevents water previously expressed from the web from reentering as the web passes into the next portion of the pressing zone. This invention also exploits the principles associated with the phenomenon of web crushing by applying a comparatively low pressure in the first portion of the extended zone, where the web moisture is highest, and comparatively high pressure in the last portion of the zone, where the web moisture is lowest. Thus, in the first portion where the web is more incompletely formed, the water is comparatively gently urged out of the web so as to not disturb the position of the water laid fibers forming the web. If water is forced out of a web too fast, thin spots and even holes are formed in the web where the fibers have been displaced, thus degrading the web quality.

In succeeding portions of the zone, where the web is more completely formed, greater pressure can safely be applied without crushing the web. Thus, the maximum pressure consistent with maximum water removal without web crushing can be applied for an extended period while the web is being dewatered and is becoming relatively more dry. The faster the web becomes drier, the sooner increased pressure can be applied to speed up drying. However, since the web is progressively becoming drier, the rate of water removal decreases with each successive portion of the pressing zone.

In addition, the pressure chambers in the chamber housings are pressurized with water, or other liquid, which is intended to leak out of their periphery in a controlled manner to provide lubrication between the chamber housings and the tough, liquid impervious belts supporting the web. The rate of this leakage is constant since each pressure chamber is supplied by a constant flow control.

It is accordingly an object of the present invention to provide a mechanism which will enable pressing a high speed traveling web over a relatively extended period of time so as to overcome counter-hydraulic pressures and to achieve improved water removal in the press.

A further object of the invention is to provide a press of a type above described wherein the principles of an extended nip press can be utilized in an improved form to achieve improved and uniform pressures with a mechanism capable of operating at high speeds and rapidly extracting water without fiber disturbance (crushing) to form an improved web.

Other objects, advantages and features will become more apparent with the disclosure of the principles of the invention, and it will be apparent that equivalent structures and methods may be employed within the principles and scope of the invention, in connection with the description of the preferred embodiment and teaching of the principles of the invention in the specification, claims and drawings, in which:

DESCRIPTION OF THE PREFERRED EMBODIMENTS

Figure 1:
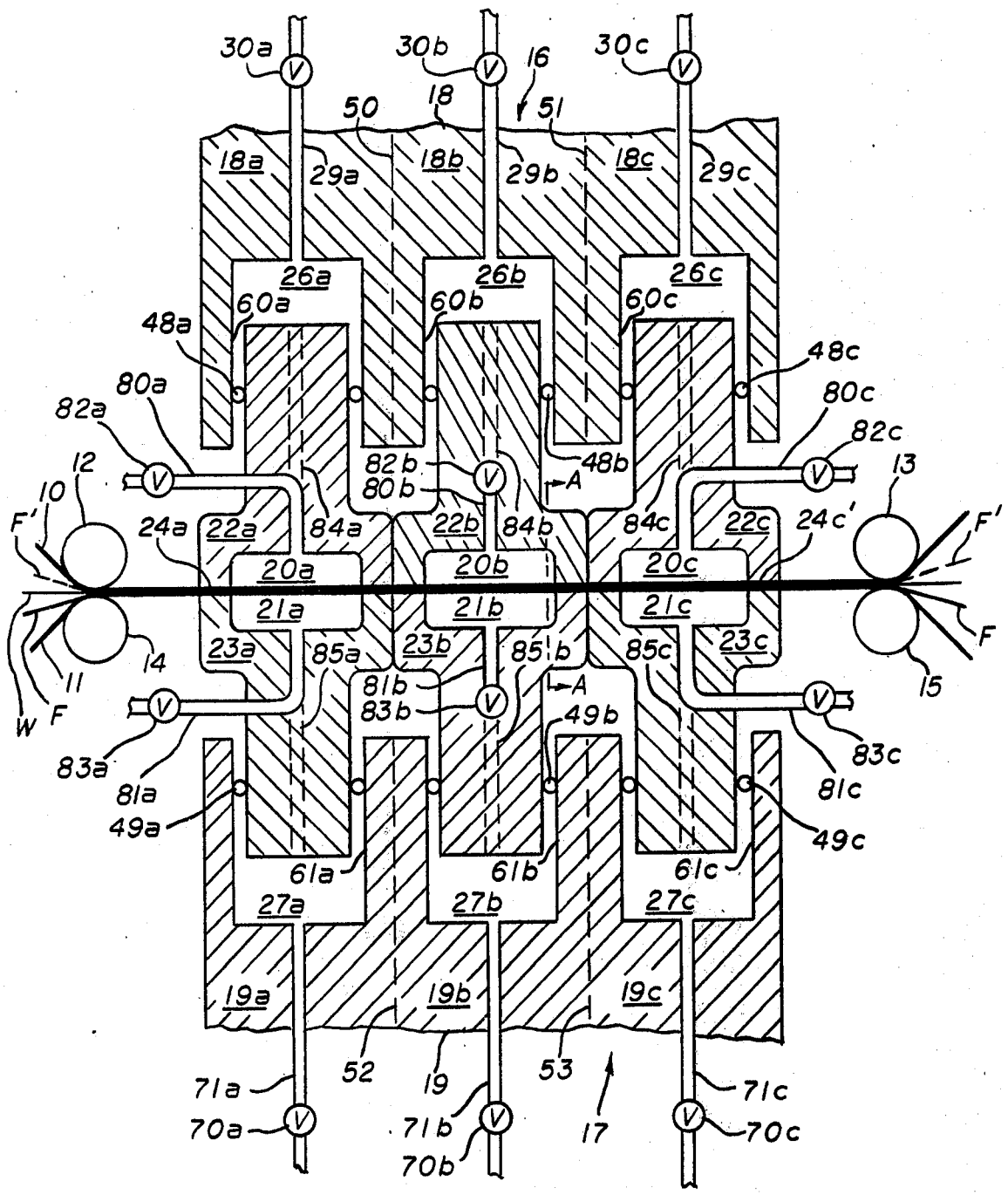
FIG. 1 is a side elevational view, shown somewhat in schematic, of a mechanism embodying the principles of the present invention.

As shown in FIG. 1, a web W is laid onto a traveling felt F to pass through the extended nip press shown in the drawing. The web laid on the felt is carried between looped flexible belts 10 and 11. Each of the belts is of a heavy extremely tough, flexible, liquid impervious material such as reinforced rubber, thin metal or plastic to carry the web and felt therebetween and to transmit hydraulic pressure which is applied to the outer surface of the belts to press the web sandwiched therebetween. The pressed web is moist having come from the forming section of a paper machine such as from a fourdrinier forming wire. Suitable pick-up mechanism is provided to transfer the web from the fourdrinier section to the press of FIG. 1, and suitable additional equipment will be provided to receive the paper web as it leaves the press to carry it onto a thermal drying section of the machine and subsequently onto a calender or other equipment for completing the processing of the web.

The belts may each be driven such as by driving their carrying rolls, and the upper looped belt is carried on rolls such as 12 and 13 positioned to guide the belt through the press. The lower looped belt is guided on similar rolls 14 and 15.

The pressing structure for applying a hydraulic pressure to the belts is shown at 16 for the top belt and at 17 for the bottom belt. During the time the web is carried between the belts, it is exposed to the hydraulically applied pressure and this period of travel will be referred to as the pressing zone.

The pressing zone is arranged in steps or portions, and a successively higher pressure is applied at each portion of the pressing zone throughout the extended nip press. With this method, the pressure of the liquid escaping from the web can build up to an optimum point for maximum egress of the liquid, but not to a point where excessive resistance pressure occur within the web such as to disorient or disrupt the fibers within the web. The flow is orderly through the fibers from the web into the felt. Since the extended nip subjects the web to a continuous pressure over an adequate length of time, the water can escape from the web until optimum dryness from mechanical pressing is obtained. The pressures chosen for each successive portion of the pressing zone can be determined experimentally, but are related to the various factors that affect the nature of the web and its moisture content. The hydraulic pressures which will build up will be dependent upon the type, size and length of the fibers employed, the thickness of the web, its initial formation, the type of web handled, the temperature of the water and so forth. For optimum operation, the initial pressure is at least 100 pounds per square inch, and the pressure in the final chamber will be on the order of 600 pounds per square inch or greater. As an example, with the structure shown in FIG. 1 which employs three successive portions of the pressing zone, the initial chamber may have a pressure of 200 pounds per square inch, the next chamber 400, and the third 600 pounds per square inch. Inasmuch as the pressure is applied hydraulically, uniform pressure will exist over the entire width of the web for the length of the portion of the zone to obtain uniform dewatering.

Throughout the specification, alphabetical subscripts will be used to distinguish identical items in a figure and primes will be used to designate similar or corresponding items in other embodiments or figures.

The first portion of the pressing zone is furnished by the opposed belt pressure chambers 20*a* and 21*a* as shown in FIG. 1. The next portion is provided by the opposed belt pressure chambers 20*b* and 21*b*, and the last portion of the pressing zone is provided by opposed belt pressure chambers 20*c* and 21*c*. These pressure chambers are formed in the belt engaging ends of the corresponding piston-like chamber housings 22*a* and 23*a*, 22*b* and 23*b*, and 22*c* and 23*c*, respectively. Depending upon the types of web handled and other factors such as the amount of water to be handled, as few as two portions may be employed or substantially more than three may be employed if necessary. For handling the dewatering of a conventional paper web, three chambers will provide for an adequate release of water without building up excess flow velocity of water within the web.

Each of the portions of the pressing zone, as constituted by the pressing chamber, is of substantially the same construction and, therefore, only the structure which forms the belt pressure zone portion 20*a* need be described in detail.

The pressure chambers are hydraulically held against the belt, and the pressure chambers for the entire pressing zone are shown as supported on opposed beams 18 and 19 which may be either of unitary construction or divided into individual beams 18*a* – 18*c*, 19*a* – 19*c* corresponding to chamber housings 22*a* – 22*c*, 23*a* – 23*c* as shown by dash lines 50, 51, 52, 53. These beams may bow upwardly with the application of pressure, but in the arrangement illustrated, each chamber housing that forms the belt pressure chamber is itself hydraulically supported so that the bending upwardly and downwardly of beams 18 and 19, respectively, will not adversely affect the hydraulic pressure applied to the belts, but will operate to provide uniform pressure on the belts.

The chamber 20*a* is provided in chamber housing 22*a* which has sidewalls or edges 24*a*, 24*a*′, 25*a*, 25*a*′ in sliding engagement with the belt 10 as shown in FIGS. 1, 5, 6 and 10. The wall engaging the belt on the oncoming side of the chamber is shown at 24*a*, and the wall or sill engaging the belt on the off running side of the chamber 20*a* as shown at 24*a*′. Similar walls 25*a*, 25*a*′, extending in the direction of belt travel, are provided at the side of the chamber so that the liquid within the chamber 20*a* is confined to the desired extent to apply its pressure to the flexible belt.

As shown in FIG. 1, chamber housings 22*a*, *b*, *c* are movable independently of one another in beam 18. A slightly modified embodiment would be to divide beams 18, 19 into smaller beam sections 18*a*, *b*, *c*; 19*a*, *b*, *c* corresponding to chamber housings 22*a*, *b*, *c*; 23*a*, *b*, *c*, respectively. This is shown by dash lines 50, 51, 52, 53.

Chamber housing 22*a* is backed by liquid in a supporting chamber 26*a*. Similarly, chamber housing 23*a* is backed by liquid in supporting chamber 27*a*. Seals 48*a*, *b*, *c*; 49*a*, *b*, *c* secure the interface between rigid structural peripheral walls 60*a*, *b*, *c*; 61*a*, *b*, *c* of the beams and the housing chambers against fluid escape.

Fluid under pressure, preferably water, is directed into the supporting chambers 26*a*, 27*a* through hydraulic supply lines 29*a*, 71*a* and valves 30*a*, 70*a* which control the pressure. Additional fluid, preferably water, is introduced under pressure into pressure chambers 20*a*, 21*a* through hydraulic supply lines 80*a*, 81*a* and the flow or volume quantity is controlled by valves 82*a*, 83*a*. The water introduced into pressure chamber 20*a* may be under the same or different pressure as the water in supporting chamber 26*a*, as determined by the respective areas of each chamber.

If it is anticipated that nearly the same pressure will be constantly used in the supporting and pressure chambers, an alternate embodiment would be to connect them via hydraulic conduits 84*a*, 85*a* in the chamber housing as shown in dashed lines. In this case, the upper area of each chamber housing would be designed to be in balance with the area of the pressure chamber bearing against the belt to insure the desired sealing force of the chamber housing edges against the belt when some hydraulic pressure loss occurs in conduit 84*a*, 85*a*. These edges may be of metal or maybe coated with Teflon (Reg. T.M.) or other low friction material that provides the degree of desired sealing and which permits the belt to travel past at the speed of travel of the paper web. The belt, and, if desired, the seal-like edges of the walls, are sufficiently flexible to permit flexure and degree of desired sealing as the belt travels.

In fact, the seal forming the interface between edges 24*a*, 24*a'*, 25*a*, 25*a'* of the pressure chamber and the traveling belt is intended to be relatively loose to permit a controlled amount of water to escape across the edges from the pressure chamber to provide lubrication of the sliding surfaces. The water escaping between edges 24*a'*, 24*b* travels upwardly, as shown by the arrows in FIG. 10, where it is removed by means, not shown, such as a drainage conduit or a suction pump.

Figure 6:
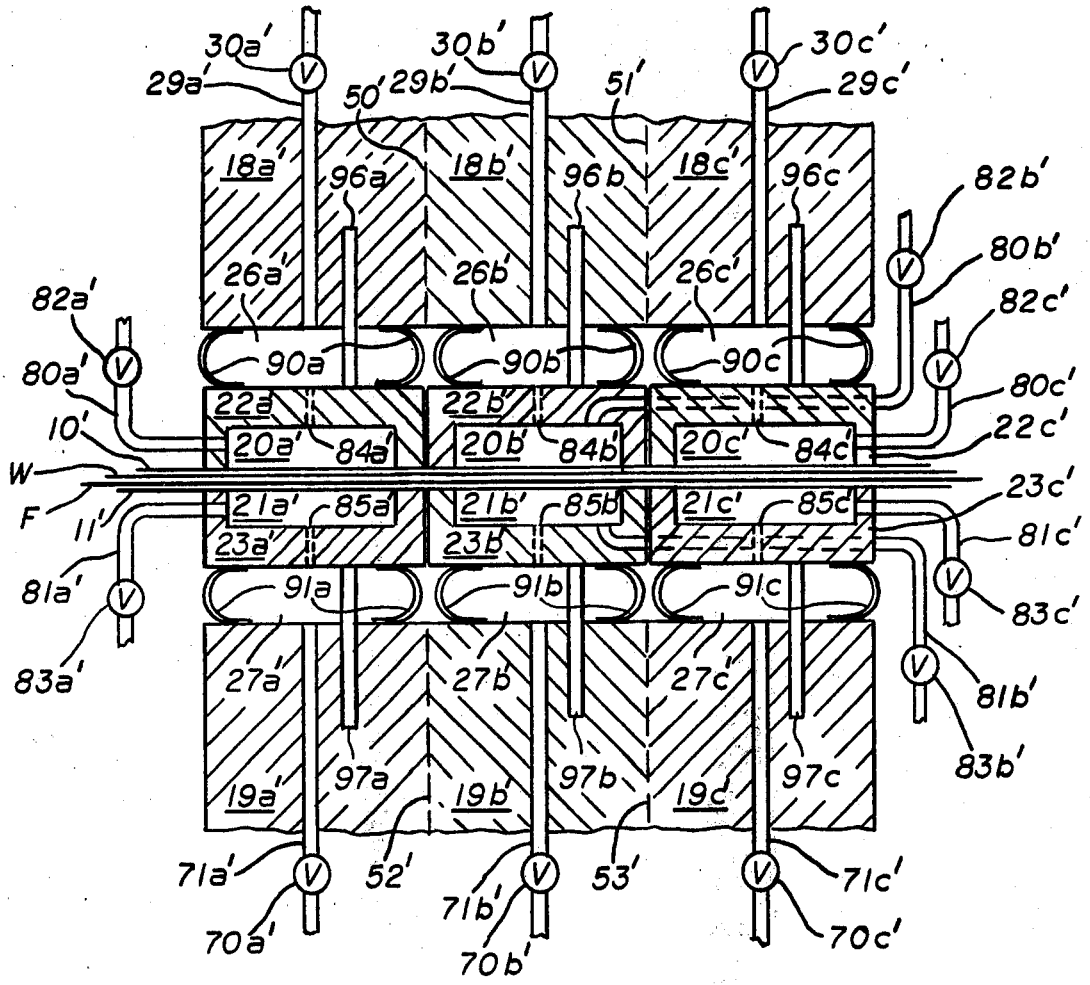
FIG. 6 is a side elevational view, shown somewhat in schematic, of another mechanism embodying the principles of the present invention.
Figure 7:
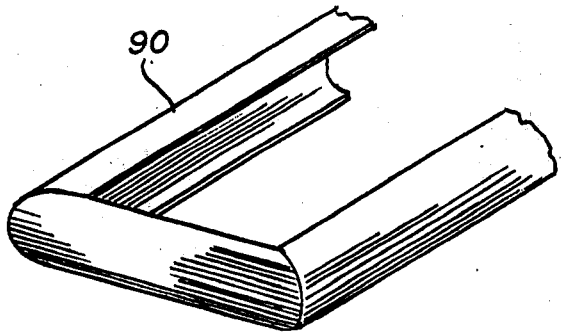
FIG. 7 is a perspective view of the flexible diaphragm forming the outer walls of the supporting chambers in FIG. 6.
Figure 8:
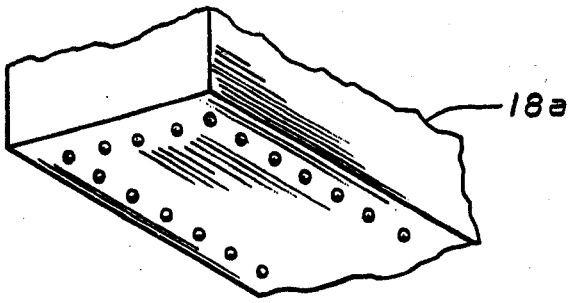
FIG. 8 is a perspective view of the beam into which the flexible diaphragm shown in FIG. 7 is mounted.
Figure 9:
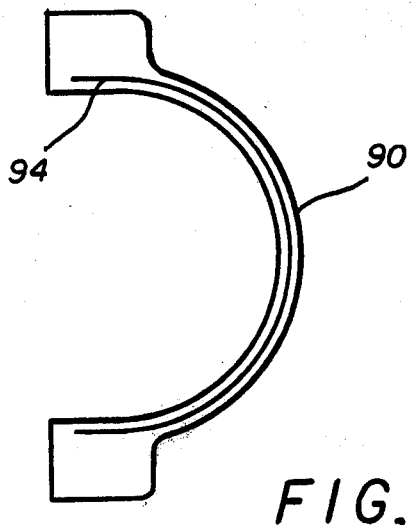
FIG. 9 is a sectional and elevational view of the diaphragm shown in FIGS. 6 and 7.
Figure 10:
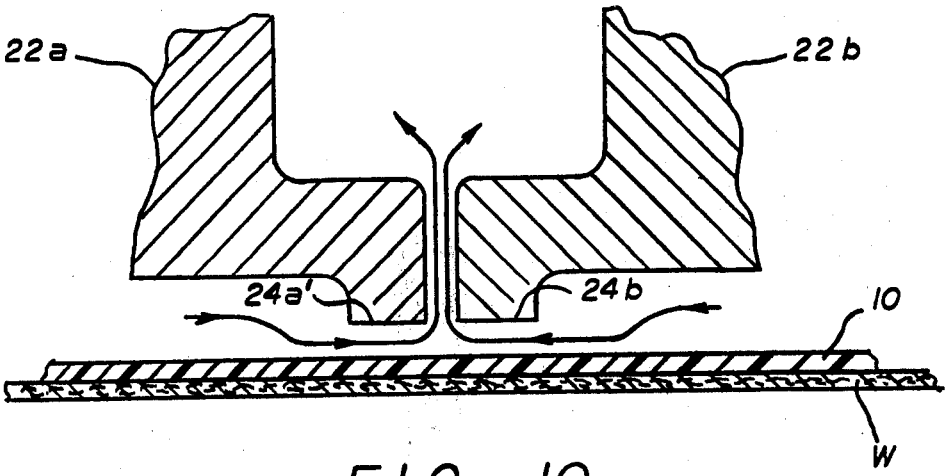
FIG. 10 is a partial view of two adjacent chamber housings, showing the manner of lubrication with water against the traveling belt.

Another embodiment is shown in FIG. 6. Each chamber housing, such as 22*a'*, is attached to the beam by a flexible, peripheral diaphragm 90, as shown in more detail in FIGS. 7 and 9. A metal fabric 94 provides the strength to withstand the high hydraulic pressures required. The diaphragm itself is constructed of an elastomeric material, such as rubber. The diaphragm is secured to the beam and a chamber housing with suitable means, such as screws and clamping bars to define the flexible walls of support chambers 26*a'*, *b'*, *c'* and 27*a'*, *b'*, *c'*.

In order to insure that the chamber housings are maintained in proper alignment while being capable of small upward and downward movement under operating conditions, at least one guide rod 96*a* (97*a*) is attached to the upper side of each chamber housing 22*a'* (23*a'*) and slidably guided in beam members 18*a'* (19*a'*).

The manner of pressurizing both pressure chambers 20*a'* and chamber housing 22*a'* is the same as in the embodiment shown in FIG. 1, that is they can be either independently pressurized through hydraulic supply lines 29*a'*, 80*a'* or interconnected through a connecting hydraulic conduit 84*a'* to be pressurized at nearly the same pressure, as desired.

As diaphragms 90*a*, 90*b* on adjacent chamber housings are pressurized and/or move up and down in operation, there may be some slight relative movement or contact, but since they are flexible, this does not raise any stress or strain. Total upward or downward movement of the chamber housings in operation is anticipated to range from about 0.001 inches to about 0.020 inches, depending on such factors as belt and felt construction and the nature of the web being conveyed.

Thus, it is seen that with either embodiment, the supporting chambers are pressurized to provide the desired force of the individual chamber housings against the traveling belts. Then, the individual pressure chambers can be either pressurized with the same pressure or another pressure to provide the operating dewatering force against the belt, felt or web as well as supplying the lubricating water seeping out over the peripheral edges of the chamber housings from the pressure chambers. The embodiments wherein support and pressure chambers are separately pressurized are, of course, more flexible than the embodiments wherein corresponding support and chamber housings are linked with a hydraulic conduit to provide the same pressure within each support and pressure chamber.

Figure 2:
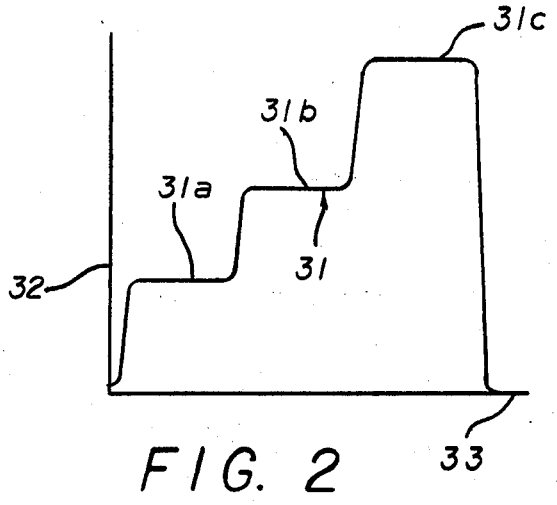
FIG. 2 is a graph illustrating the pressure on the web as a function of position of the web as it passes through the pressing zone.
Figure 3:
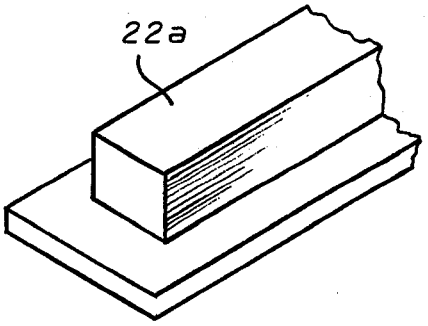
FIG. 3 is a perspective view of the piston-like apparatus forming each of the chamber housings in FIG. 1.
Figure 4:
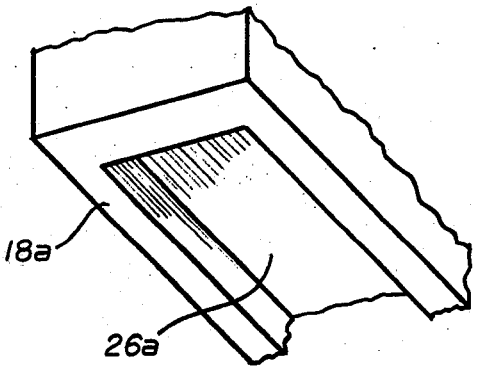
FIG. 4 is a perspective view of the beam into which the chamber housings are slidably mounted.
Figure 5:
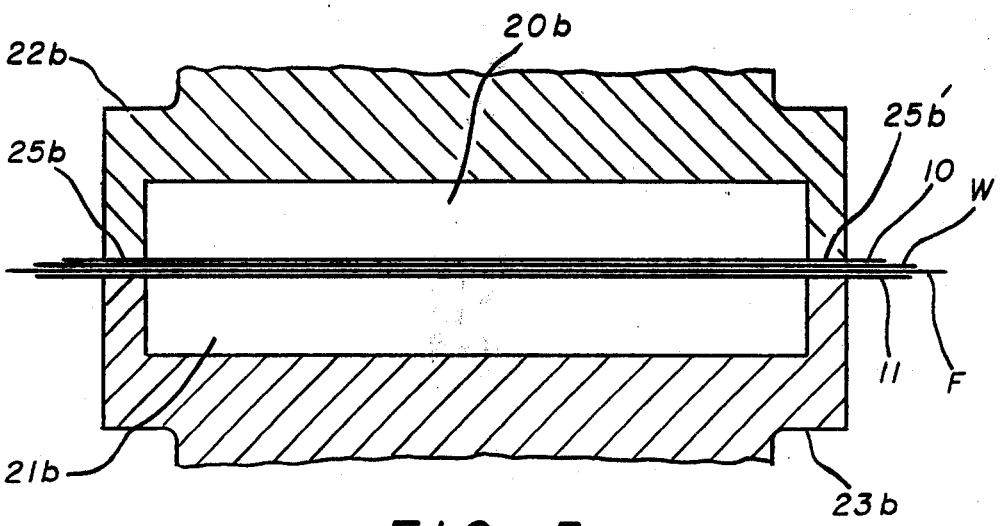
FIG. 5 is a view through section A—A of FIG. 1.

In operation, the pressure in the second pressure chambers 20*b* and 21*b* is higher than the first pressure within chambers 20*a* and 21*a*. The walls between the chambers are sufficiently thick and strong to isolate the chambers from each other, but as the belt passes from a first chamber to a succeeding chamber, only a limited pressure drop for a brief instant of time is felt by the web when the pressure increases stepwise as shown in the graph of FIG. 2. The pressure in the third belt pressure chambers 20*c* and 21*c* is higher than in the second belt pressure chambers 20*b* and 21*b*.

This is shown in FIG. 2 where the pressure in the first portion of the pressing zone is shown at 31*a*, the pressure in the second portion at 31*b*, and the pressure in the third portion at 31*c* of the pressure graphline 31. The coordinates 32 and 33 indicate pressure and position of the web as it passes through the pressing zone, respectively. As will be noted, when the web passes the trailing edge of the last portion of the pressing zone, the pressure immediately and suddenly drops back to zero, so that web rewetting is kept at a minimum. By sudden drop in pressure on the web from maximum pressure, travel of the moisture from the felt back into the web, i.e. rewetting, will be minimized. The trailing guide rolls 13 and 15 are maintained at a position so that there is no contact between the paper and felt after they pass the press.

It will be understood that the method and principles of this invention may be employed in other structures. For example, the lower belt may be supported on a rigid surface which permits the belt to slide or travel thereover with the hydraulic pressure being applied solely to one belt. One form of this structure which may be employed is where the lower belt is carried on the surface of a rotating cylinder, and the chambers for applying successive steps of pressure to the upper belt are arranged arcuately. Also, the web may be carried directly on a roll surface with the lower belt omitted. Another contemplated arrangement will utilize two felts with the web sandwiched therebetween, one felt against each of the belts. The additional felt is shown in FIG. 1 as a dashed line designated F'. The belts may be configured on their surface facing the felts so as to permit improved passage of water to the felt such as by being provided with pockets or longitudinal or herringbone or shaped small grooves sufficiently small to prevent marking of the web but adequate to aid in the flow of water into the felt. Water removal means may be provided on the offrunning side of the belts after they are separated from the felt to clear any residual water which may pass into the belt grooves.

With the structure and method shown, the resultant disadvantages when the pressure is applied at a very fast rate are avoided. This rapid application of pressure which can cause a disruption in the web formation or structure is commonly called crushing. It occurs particularly to heavily beaten stock or heavy basis weight webs. The avoidance of crushing and the disrupting force which is caused by high local fluid velocity is avoided without the necessity of lowering the speed of the machine, and the pressure differential between the different portions of the zones of the structure of FIG. 1 and the length of the zones can be constructed dependent in part upon the speed at which the machine is to be operated. While the pressure normally will increase stepwise between the successive portions of the zone as shown in FIG. 2, a slightly less drastic change between zone portions can be obtained by shaping or angling the sills which engage the belt on the offrunning and onrunning side of the chambers. By relieving the trailing end of the sill on the onrunning side, and perhaps elongating the sill, the rate of pressure increase from one portion of the pressing zone to the next, will be more gradual.

I claim:

1. A press structure for performing a dewatering operation in the process of formation of a traveling fibrous web, comprising:

at least one felt for traveling with the web in water receiving contact therewith;

a pair of looped, fluid impervious belts for traveling with the web for carrying the web and felt therebetween;

first hydraulic pressure means for applying a uniform first pressure to a first area along the travel of the belts to force water from the web at a high rate of speed, said rate being less than that at which fiber crushing occurs;

second successive hydraulic pressure means immediately adjacent the first hydraulic pressure means for applying a uniform second pressure to a second area along the travel of the belts, said second pressure being greater than the first pressure and sufficient to cause additional water to flow from the web at a second rate less than the rate at which fiber crushing occurs so that the water can flow from the web without excess water flow velocity building up within the web;

said first and second hydraulic pressure means each including a beam and a chamber housing arranged to define a hydraulic supporting chamber therebetween;

each chamber housing including a pressure chamber exposed to the traveling belts, so that pressurized fluid supplied to the supporting chamber urges the chamber housing against the traveling web and pressurized fluid applied to the pressure chamber provides water expressing force against the web; and each beam and chamber housing being linked by a flexible diaphragm to define the peripheral walls of the supporting chamber.

2. A press structure constructed in accordance with claim 1, further including:

at least one guide rod to guide each chamber housing in movement normal to the belts under the impetus of operating forces.

* * * * *